United States Patent [19]

Rowan et al.

[11] 4,362,292

[45] Dec. 7, 1982

[54] OVERHEAD HOIST ASSEMBLIES

[76] Inventors: Donald J. Rowan, Box 91; Larry J. Rowan, Box 54; Kenneth L. Rowan, Box 82, all of Elkhorn, Manitoba, Canada

[21] Appl. No.: 242,913

[22] Filed: Mar. 12, 1981

[30] Foreign Application Priority Data

Mar. 14, 1980 [CA] Canada ..... 347666

[51] Int. Cl.[3] ..... B66D 1/54; B66C 15/00

[52] U.S. Cl. ..... 254/336; 254/334; 254/389; 212/213; 414/340

[58] Field of Search ..... 254/272, 273, 277, 284, 254/285, 286, 334, 336, 337, 392, 398; 212/125, 128, 142, 205, 211, 213, 221; 414/191, 348, 342

[56] References Cited

U.S. PATENT DOCUMENTS

| | | | |
|---|---|---|---|
| 2,063,914 | 12/1936 | Fitch | 212/142.1 X |
| 2,609,954 | 9/1952 | Sutherland et al. | 212/221 X |
| 2,613,823 | 10/1952 | Johns | 212/142.1 X |
| 2,701,065 | 2/1955 | Bertel | 212/221 X |
| 3,078,115 | 2/1963 | Harlander et al. | 212/125 X |
| 3,602,375 | 8/1971 | Martinson | 414/542 X |
| 3,893,571 | 7/1975 | Metailler | 212/211 X |

FOREIGN PATENT DOCUMENTS

| | | | |
|---|---|---|---|
| 637381 | 5/1950 | United Kingdom | 254/398 |
| 920045 | 3/1963 | United Kingdom | 254/398 |

*Primary Examiner*—Billy J. Wilhite
*Assistant Examiner*—Frankie L. Stinson
*Attorney, Agent, or Firm*—Stanley G. Ade

[57] ABSTRACT

When a hoist is used to elevate a grain truck for dumping same, at an elevator terminal or the like, a pair of lift cables extend from the overhead hoist assembly to the cradle upon which the front wheels of the truck are engaged. As the truck is lowered after emptying the grain therefrom, the slack cables often foul the truck as it is being driven from the cradle. In the present device, each cable passes through a spring loaded arm normally urging the cables outwardly away from the sides of the truck thereby clearing same, but which are aligned against the spring pressure as soon as the lifting load is applied so that the cables run vertically from the hoist assembly.

8 Claims, 2 Drawing Figures

OVERHEAD HOIST ASSEMBLIES

BACKGROUND OF THE INVENTION

This invention relates to new and useful improvements in overhead hoist assemblies, particularly overhead hoist assemblies used in locations such as grain elevators or the like where grain trucks are driven into the elevator upon a cradle, are elevated by the overhead hoist assembly to dump the grain and are then lowered so that the grain truck can drive from the grain elevator. Such devices are common because of the desirability and necessity of unloading grain trucks rapidly and easily.

With conventional overhead hoist assemblies, a cradle is usually provided with a cable being attached to each end thereof and extending upwardly to an overhead hoist assembly. The front wheels of the truck are driven onto the cradle whereupon same is raised to dump the grain. After dumping, the truck is lowered and is driven from the terminal. However, the slack cables often engage the sides of the truck inadvertently and cause delay and sometimes damage to the truck and/or hoist assembly.

SUMMARY OF THE INVENTION

The present invention overcomes disadvantages inherent with such overhead hoist assemblies by providing a spring loaded arm assembly for said cable which normally swings the cable outwardly and away from the truck when the cable is slack but which permits the cable to align vertically with the hoist assembly when the load is applied.

In accordance with the invention there is provided, in an overhead hoist assembly which includes a pair of spaced apart cables extending downwardly therefrom and being operatively connected to said hoist assembly; the improvement comprising a cable guiding arm assembly for each cable, means to support said arm assembly from said hoist assembly, means on said arm assembly guiding said cable, and spring means normally urging said arm assemblies outwardly away from one another thereby displacing said cables from the vertical, tension on said cables above a predetermined amount, overcoming said spring means and allowing said cables to straighten and run vertically.

Another advantage of the invention is to provide a device of the character herewithin described which is easily fitted to existing overhead elevators and which assists in reducing considerably, any chance of the slack cables becoming hung up or caught in or upon the truck passing therebetween.

Another advantage of the present invention is to provide a device of the character herewithin described which is simple in construction, economical in manufacture and otherwise well suited to the purpose for which it is designed.

With the foregoing in view and other advantages as will become apparent to those skilled in the art to which this invention relates as this specification proceeds, the invention is herein described by reference to the accompanying drawings forming a part hereof, which includes a description of the preferred typical embodiment of the principles of the present invention, in which:

DESCRIPTION OF THE FIGURES

In the drawings like characters of reference indicate corresponding parts in the different figures.

DETAILED DESCRIPTION

Figure 1:
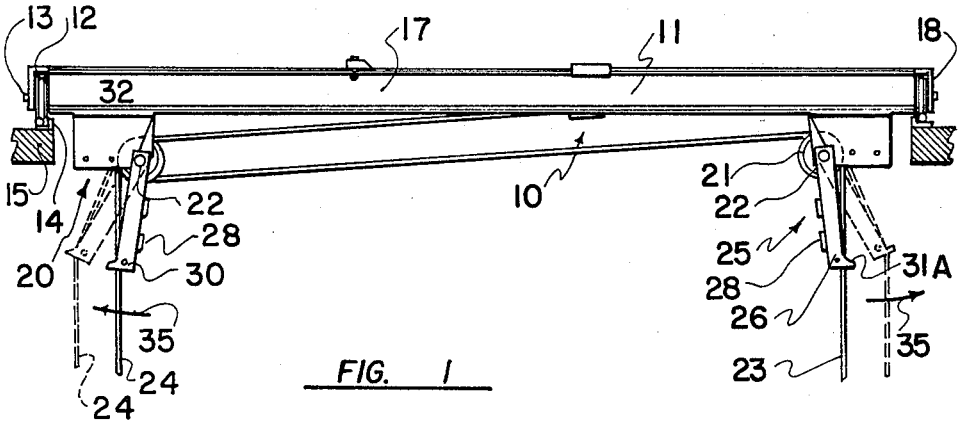
FIG. 1 is a front elevation of the invention.

Proceeding therefore to describe the invention in detail, it will be appreciated that the overhead hoist assembly collectively designated 10 is conventional in design. Briefly, it consists of an overhead beam assembly 11 having wheels 12 at each end thereof mounted upon spindles 13 and engaging angle iron tracks 14 supported upon overhead structure 15 so that the beam assembly can be moved in either direction as indicated by double headed arrow 16. The beam assembly includes a pair of transverse members 17 maintained in the spaced apart relationship by means of side plates 18, it being understood that there are four wheels 12 journalled one adjacent each corner of the structure. The wheels may be provided with V grooves and engage track rods 19 welded within the angle iron tracks 14 as clearly shown in FIG. 2.

A bracket assembly collectively designated 20 is secured on the underside of each side of the beam assembly and cable pulleys or sheaves 21 are journalled for rotation within these bracket assemblies 20, upon shafts or pins 22.

A pair of cables 23 and 24 extend over the sheaves and downwardly to a truck engaging cradle (not illustrated) and the upper ends of the cables extend to a hoisting mechanism (not illustrated) within the beam assembly 11 and which is conventional.

Under normal load conditions, the cables 23 and 24 extend vertically downwardly to the cradle, but when no load is upon cables 23 and 24, the runs thereof are slack and may foul the truck which is situated therebetween.

The invention collectively designated 25 consists of an arm assembly which reduces the possibility of cables becoming fouled with the truck. Each arm assembly comprises a pair of side plates or brackets 26 pivotally secured by the upper ends 27 thereof, one upon each end of the spindle or shaft 22 journalling the sheaves 21 within brackets 20.

Cross pieces 28 are welded to the pair of plates 26 and maintain same in the desired relationship one with the other and a cable sheave or roller 29 is journalled upon a pin 30 adjacent the lower ends 31 of the plates over which the cable may run.

Figure 2:
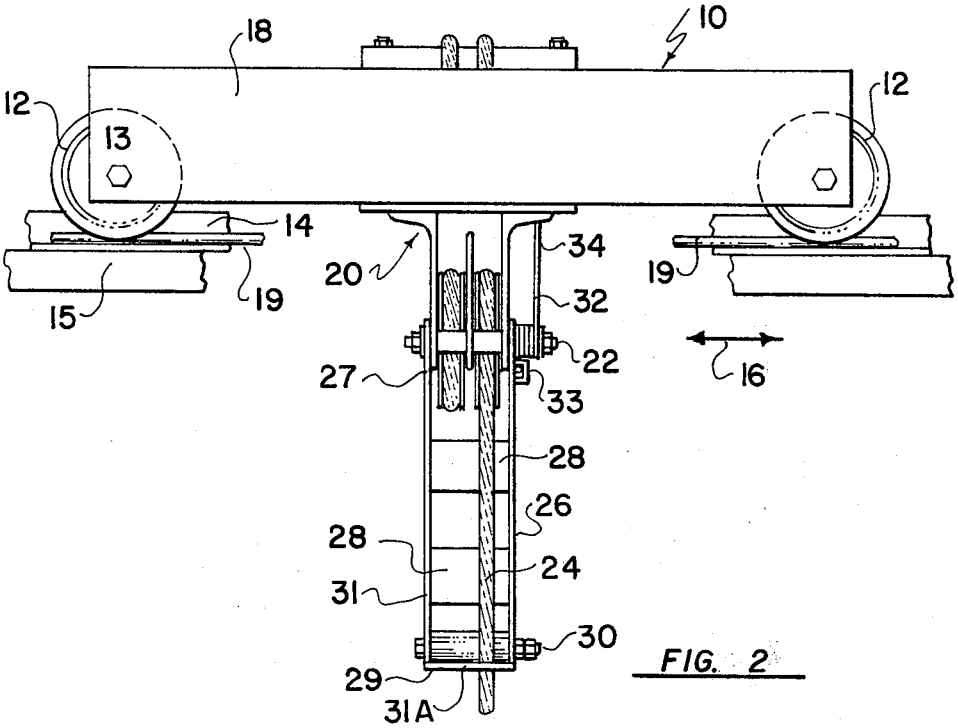
FIG. 2 is an end view of FIG. 1.

The cable retainer 31A spans the ends of the plates outboard of the roller 29 so that cable 24 extends between the roller and the retainer as clearly shown in FIGS. 1 and 2.

A coil spring 32 engages around one end of spindle or shaft 22 and is secured by one end thereof within retainer 33 on one of the side plates or brackets 26. The other end is engaged with the upper side of the bracket assembly by means of the extending leg 34 of the spring which is so positioned that normally it urges the arm assemblies 23 outwardly away from one another in the direction of arrows 35.

When the cables 23 and 24 are slack, the tension of the springs 32 urge the arms outwardly to the position shown in phantom in FIG. 1 thus moving the lower portions of the cables outwardly away from one another and clear of the sides of a truck which may be therebetween.

However, as soon as the overhead hoist assembly is engaged, the lifting tension on cables 23 and 24 overcomes the pressure of the springs 32 so that the arms are moved inwardly to the position shown in solid line in FIG. 1 thus permitting the cables 23 and 24 to straighten and run vertically as the hoist is opered.

As hereinbefore described, as soon as the hoist is lowered, and the weight is removed from cables 23 and 24, they move outwardly once again to the position shown in phantom.

Since various modifications can be made in our invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

What we claim as our invention is:

1. In an overhead hoist assembly which includes a pair of spaced apart cables extending downwardly therefrom and being operatively connected to said hoist assembly; the improvement comprising a cable guiding arm assembly for each cable, means pivotally to support said arm assembly from said hoist assembly, means on said arm assembly guiding said cable, and spring means normally urging said arm assemblies outwardly away from one another thereby displacing said cables from the vertical, tension on said cables above a predetermined amount, overcoming said spring means and allowing said cables to straighten and run vertically.

2. The invention according to claim 1 in which each arm assembly includes a cable sheave journalled for rotation within the distal end of said arm assembly and a cable retainer spanning said arm assembly outboard of the cable.

3. The invention according to claim 1 in which each of said arm assemblies includes a pair of spaced and parallel side straps, pivotally secured by one end thereof to said overhead hoist assembly, said spring means reacting between said side straps and said overhead hoist assembly.

4. The invention according to claim 2 in which each of said arm assemblies includes a pair of spaced and parallel side straps pivotally secured by one end thereof to said overhead hoist assembly, said cable sheave being journalled between adjacent the distal ends of said straps, said retainer spanning said straps.

5. The invention according to claim 1 in which said overhead hoist assembly includes cable guiding sheaves, and shafts journalling said sheaves for rotation upon said overhead hoist assembly, each of said arm assemblies being pivotally supported by the inner ends thereof upon one of said shafts.

6. The invention according to claim 2 in which said overhead hoist assembly includes cable guiding sheaves, and shafts journalling said sheaves for rotation upon said overhead hoist assembly, each of said arm assemblies being pivotally supported by the inner ends thereof upon one of said shafts.

7. The invention according to claim 3 in which said overhead hoist assembly includes cable guiding sheaves, and shafts journalling said sheaves for rotation upon said overhead hoist assembly, said side straps being pivotally supported by the inner ends thereof upon one of said shafts.

8. The invention according to claim 4 in which said overhead hoist assembly includes cable guiding sheaves, and shafts journalling said sheaves for rotation upon said overhead hoist assembly, said side straps being pivotally supported by the inner ends thereof upon one of said shafts.

* * * * *